United States Patent [19]

Watanabe et al.

[11] 4,235,061

[45] Nov. 25, 1980

[54] APPARATUS FOR DETECTING IRREGULAR ARRANGEMENT OF COINS IN COIN PACKAGING MACHINE

[75] Inventors: Kenkichi Watanabe; Katusuke Furuya; Hitoshi Kamada, all of Tokyo, Japan

[73] Assignee: Laurel Bank Machine Co., Ltd., Tokyo, Japan

[21] Appl. No.: 962,601

[22] Filed: Nov. 21, 1978

[30] Foreign Application Priority Data

Nov. 25, 1977 [JP] Japan ..... 52-142072

[51] Int. Cl.[3] ..... B65B 57/14; B65B 11/04

[52] U.S. Cl. ..... 53/54; 53/77; 53/212; 133/1 A; 209/602

[58] Field of Search ..... 53/54, 77, 507, 212; 133/1 A; 209/602

[56] References Cited

U.S. PATENT DOCUMENTS 3,469,365 9/1969 Uchida et al. ..... 53/54

3,530,638 9/1970 McCollough ..... 53/77

4,123,892 11/1978 Asami ..... 53/212 X

*Primary Examiner*—Travis S. McGehee

*Attorney, Agent, or Firm*—Fleit & Jacobson

[57] ABSTRACT

There is provided an apparatus for detecting irregular arrangement of accumulated coins for use in a coin packaging machine wherein a predetermined number of accumulated coins are delivered from an accumulating cylinder to a packaging zone by a pair of delivery arms and packaging them in the packaging zone. The pair of delivery arms, an upper delivery arm and a lower delivery arm, is constructed so that it is rotatable between a coin accumulating zone and a coin packaging zone and vertically slidable to engage with and disengage with the accumulated coins in the coin accumulating zone. The delivery arms are insulated from each other. A detection circuit is provided for detecting the irregular arrangement of the accumulated coins by sensing the height of the upper delivery arm indicating at the irregular arrangement of the accumulated coins.

7 Claims, 3 Drawing Figures

APPARATUS FOR DETECTING IRREGULAR ARRANGEMENT OF COINS IN COIN PACKAGING MACHINE

BACKGROUND OF THE INVENTION

The present invention relates to a coin packaging machine for delivering a predetermined number of accumulated coins for an accumulating cylinder to a packaging zone by a delivery arm and packaging them in the packaging zone.

Methods for accumulating a predetermined number of counted coins in an accumulating cylinder and delivering them to a packaging zone by a delivery arm are roughly divided into two types. According to one type, accumulated coins discharged from the lower portion of the accumulating cylinder are supported from the lower side by the delivery arm and introduced into the packaging zone disposed below for packaging the coins. According to the other type, the accumulated coins in the accumulating cylinder are supported from the upper and lower sides by upper and lower arms and, when a two-split accumulating cylinder is opened, the accumulated coins are turned in the horizontal direction and delivered to the packaging zone for packaging. In each method, the accumulating cylinder is vibrated to arrange coins correctly in the horizontal direction. However, when large quantities of coins are packaged at a high speed, it is difficult to accumulate the coins perfectly a so-called irregular arrangement phenomenon occurs where the coins are not correctly arranged in the horizontal direction.

When coins which are irregularly arranged are delivered to the packaging zone, accidents often occur in which the arranged coins scatter or fall during delivery resulting in a shortage in the number of packaged coins.

As means for detecting such irregular arrangement, optical means has heretofore been adopted. More specifically, a through-hole is formed on the side portion of the accumulating cylinder and light is projected into the cylinder so that irregular arrangement of coins is detected when the light is intercepted by the coins. However, in some case, light leaks from a gap between coins to cause a detection error. As another means for detecting irregular arrangement, there is known a method in which, since accumulated coins collapse due to irregular arrangement when the accumulated coins are supported from the upper and lower sides and the upper delivery arm is therefore brought down below the prescribed position, the position of the upper arm thus brought down is detected by a switch. This detecting method, however, is still defective in that when irregular arrangement is detected, the accumulated coins collapse and scatter.

SUMMARY OF THE INVENTION

The present invention has been perfected as a result of research conducted with a view to eliminating the foregoing defects involved in the conventional techniques. It is therefore a primary object of the present invention to provide a detecting apparatus capable of detecting assuredly the occurrence of irregular arrangement of coins accumulated in an accumulating cylinder. When coins are not regularly arranged in the accumulating cylinder in the horizontal direction, a plurality of coins are arranged vertically or obliquely. The height of the accumulated coins is therefore larger than the height of accumulation in case of regular arrangement.

According to the present invention, the abnormal height of accumulation is detected by an electrode disposed above the accumulated coins. Therefore, the detecting means of the present invention is different from conventional known means in that detection is not influenced by the state of irregular arrangement and that scattering of coins is not caused on detection. Furthermore, detection precision is not reduced by dust or the like. Accordingly, the detecting means of the present invention is advantageous and highly effective over conventional known means.

BRIEF DESCRIPTION OF THE DRAWINGS

The present invention will now be described in detail by reference to an embodiment illustrated in the accompanying drawing in which.

DETAILED DESCRIPTION OF THE PREFERRED EMBODIMENTS OF THE INVENTION

Figure 1:
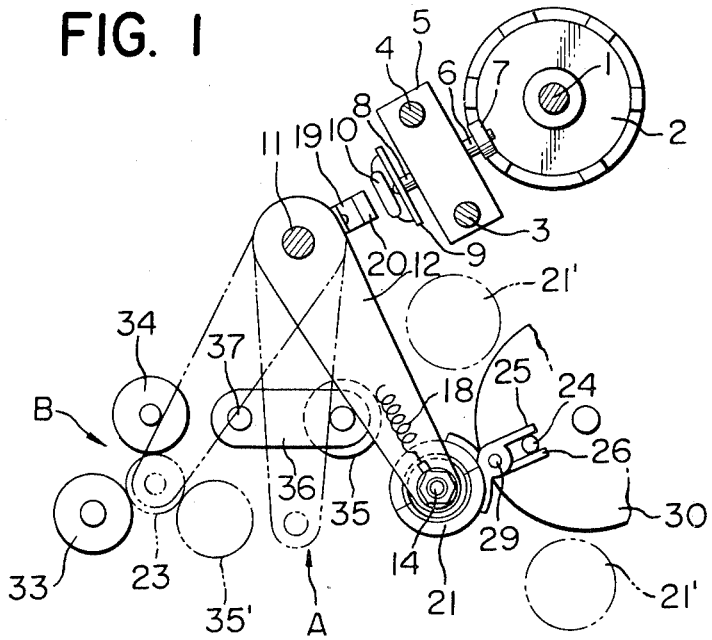
FIG. 1 is a plan view showing an apparatus for detecting irregular arrangement of coins according to the present invention.

When a coin assorting handle, not shown in the drawing, is operated, a coin assorting cam 2 fixed to a cam shaft 1 disposed to rotate with the operation of the coin assorting handle is turned. A convex-concave surface is formed on the top face of the coin assorting cam 2 so as to comply with the height of accumulation which varies depending on the kind of accumulated coins. A roller 7 rotatably fitted to a roller shaft 6 fixed to the side face of a sliding block 5 slidably fitted and inserted in guide shafts 3 and 4 is engaged with the coin assorting cam 2. Accordingly, the height position of the sliding block 5 is determined by the coin assorting cam 2 in relation to the coin kind-selecting operation by means of the coin assorting handle.

A reed switch 10 is projected from a substrate 9 attached to the other side of the sliding block 5 through a spacer 8 so that the reed switch 10 is not closed while the packaging operation is normally carried out but is closed only when the coins are irregularly arranged. Upper and lower delivery arms 12 and 13 are slidably fitted on an arm shaft 11 and a supporting pin 14 is fixed to the top end of the upper delivery arm 12 in the state electrically insulated by insulating washers 15 and 16 and insulating sleeve 17. An electric wire 18 is connected to one end of the supporting pin 14 to constitute a detecting electrode.

A magnet 20 is fixed to an attachment fixture 19 on the other end portion of the delivery arm 12. This magnet 20 is disposed so that it exactly faces the reed switch 10 when the delivery arms 12 and 13 are turned and shifted from the stand-by position (A) and located at the center of an accumulating cylinder 21 to receive accumulated coins from the accumulating cylinder 21. A supporting pin 22 is fixed to the top end of the lower delivery arm 13 to push up accumulated coins 23 from below and support them at the packaging position.

The accumulating cylinder 21 is split into two parts from the central position, and hinges 25 and 26 which come into contact with a stop pin 24 are fixed to the upper part of the side portion of the accumulating cylinder 21. Hinges 27 and 28 are fixed to the lower part. The accumulating cylinder 21 is attached to a cylindrical index head 30 by means of a shaft 29 fitted and inserted through these hinges.

An opening-closing pin 31 is fixed to the top ends of the lower hinges 27 and 28. When the accumulated coins 23 are correctly and regularly arranged, a plate cam 32 is intruded into the intermediate portion of the pin 31 to forcibly open the pin 31. Accordingly, the two-split accumulating cylinder 21 is opened and accumulated coins are delivered therefrom. A plurality of the accumulating cylinders 21 to be selected and used according to the kind of coins are mounted on the index head 30 and equally spaced apart in a radial arrangement.

A bottom plate 38 is rotatably pivoted on a receiving stand 39 by means of a shaft not shown in the drawing so that the bottom plate 38 is pushed by the supporting pin 22 by turning of the lower delivery arm 13 to open the bottom portion of the accumulating cylinder 21. The accumulated coins 23 turned and delivered horizontally in the state supported by the delivery arms 12 and 13 are introduced into a packaging zone (B), stopped when they contact packaging rollers 33 and 34 and gripped by these packaging rollers 33 and 34 and a press roller 35 advanced just behind the coins 23. A packaging paper not shown in the drawing is wound on the periphery of the accumulated coins and both the upper and lower edges of the packaging paper are inwardly folded and clamped by clamp jaws to package the coins. The press roller 35 is fixed to a supporting rod 36 which is disposed so that it is rotated about a shaft 37 as the center of rotation.

Figure 3:
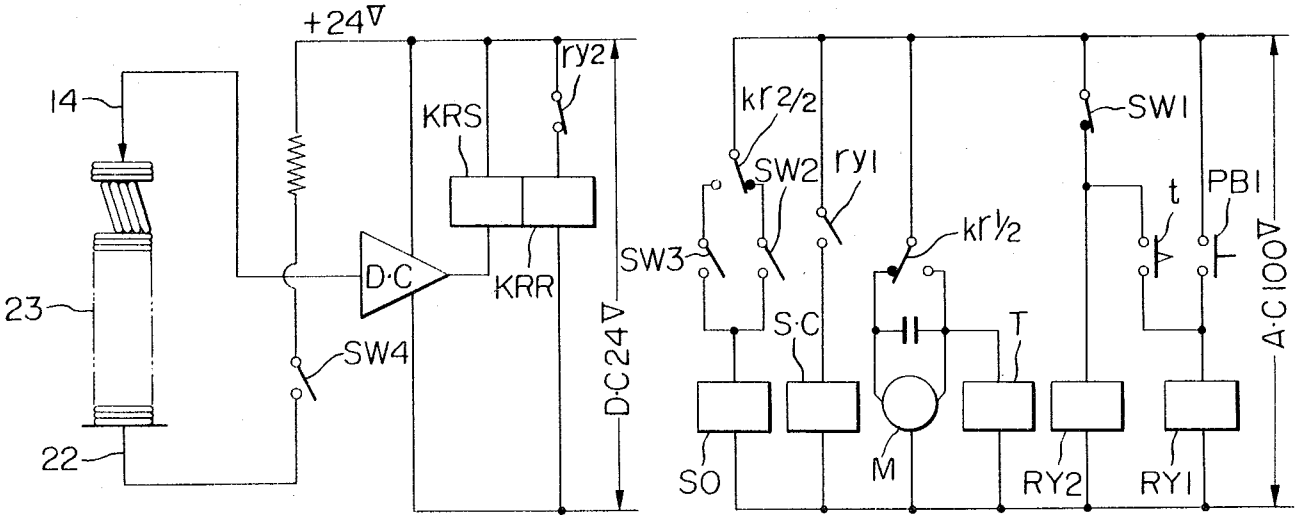
FIG. 3 is an electric circuit for use in the apparatus.

The detecting operation will now be described by refernece to a circuit diagram of FIG. 3.

When a start button PB1 is depressed, a start relay ry1 is energized to close a contact ry1 thereof. As a result, a start control circuit SC is actuated to initiate counting of coins, and the counted coins are sequentially allowed to fall into the accumulating cylinder 21 and are accumulated therein. If irregular arrangement occurs during this accumulation operation, the height of a prescribed number of the accumulated coins surpasses a certain level.

When counting of the prescribed number of coins is completed, a clutch not shown in the drawing is actuated on receipt of a signal indicating completion of counting, and a keep relay switch SW1 actuated by a cam not shown in the drawing, which is rotated synchronously with actuation of the clutch, is immediately opened to de-energize a one-rotation position-detecting relay RY2 and open a contact ry2 thereof. Accordingly, energization of the reset side (KR R) of a keep relay KR is released and the keep relay KR is kept in such state that it can be set at any time.

When the operation proceeds further and the delivery arms 12 and 13 initiate leftward turning and arrive at the center of the accumulating cylinder 21, the lower delivery arm 13 rises to push up the accumulated coins to the packaging position and the upper delivery arm 12 simultaneously starts downward movement. Accordingly, a timing switch SW4, i.e., the reed switch 10, is closed with access of the magnet 20, and a voltage is applied to the lower delivery arm 13. However, since the electrode 14 disposed above is not yet allowed to have contact with coins, a detecting circuit DC is not actuated. When the electrode 14 contacts the coins, a current is caused to flow through irregularly arranged coins to actuate the detecting circuit DC and energize the set side (KR S) of the keep relay KR.

Accordingly, a contact kr1/2 of the keep relay KR is reversely switched to cause reverse rotation in a driving motor M, whereby the upper delivery arm 12 starts rising movement from the position in contact with the accumulated coins 23 and the lower delivery arm 13 begins downward movement to return to the start position. Simultaneously with initiation of reverse rotation of the driving motor M by change-over of the contact kr1/2, an off-delay timer T is energized to close a contact t thereof. However, since the keep relay reset switch SW1 is opened, no electric current flows in the relay RY1 or the relay RY2.

Since another contact kr2/2 of the keep relay KR is changed over, an opening-closing switch SW3 for opening the accumulating cylinder 21 and bottom plate 38 is actuated to open the bottom plate 38 and the accumulating cylinder 21 during the reverse operation to return to the start position, whereby the irregularly arranged accumulated coins 23 are allowed to fall and are stored in an appropriate box or the like.

When the start position is restored, the keep relay reset switch SW1 is closed to energize the relays RY1 and RY2, and the contact ry1 is closed. Accordingly, the start control circuit SC is actuated to automatically initiate counting of coins. Then contact ry2 of the relay RY2 is also closed to excite the reset side (KR R) of the keep relay KR to change over the contacts kr1/2 and kr2/2 as shown in the drawing to initiate normal rotation in the driving motor M, whereby the stand-by operation for packaging is completed. The contact t of the off-delay timer T is arranged so that it is automatically opened after the lapse of a predetermined time.

Figure 2:
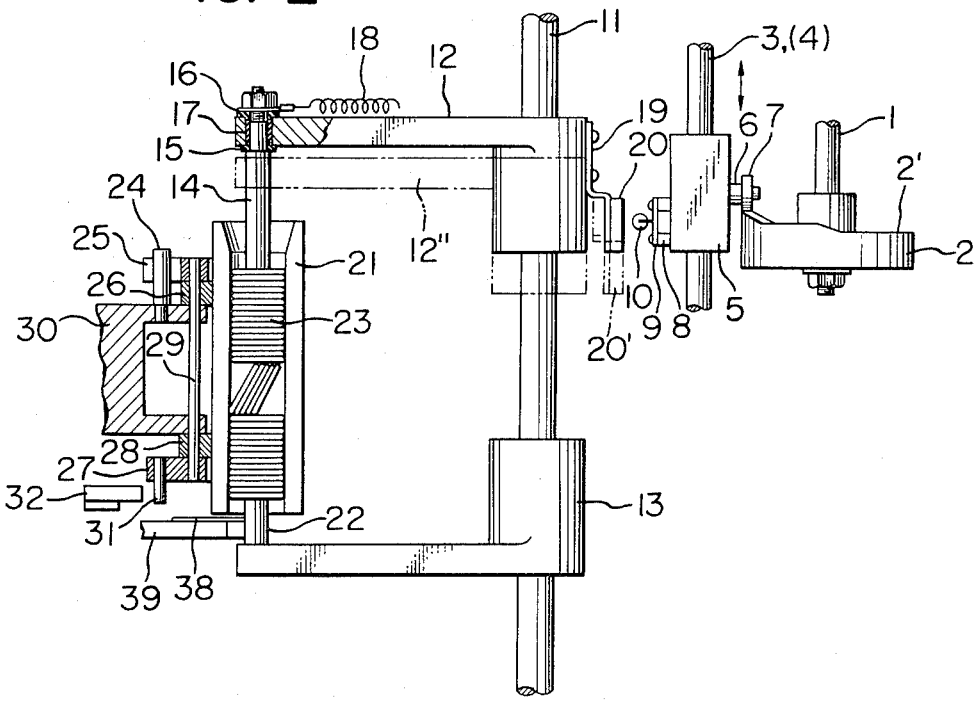
FIG. 2 is a side view.

The operation illustrated above is one conducted when coins 23 are irregularly arranged. When accumulated coins 23 are regularly arranged, since the upper delivery arm 12 is brought down to the position 12'' indicated by dotted lines in FIG. 2 and the magnet 20 actuating the timing switch 4 is brought down to the position 20', the timing switch SW4 is not closed. Hence, even if the electrode 14 contacts the accumulated coins 23 being delivered, no electric circuit is constructed and the detecting circuit is not actuated. Therefore, the normal packaging operation is continuously carried out.

In the foregoing embodiment, the upper and lower two delivery arms are used as means for delivering accumulated coins to the packaging zone. The system for detecting irregular arrangement of accumulated coins according to the present invention can be applied also to a packaging machine in which accumulated coins are brought down into the packaging zone disposed below by means of one delivery arm.

More specifically, an electrode is disposed independently above the accumulating cylinder so that it is electrically connected through accumulated coins to the bottom plate disposed in the lower portion of the accumulating cylinder, whereby the intended object of the present invention can similarly be attained by the same technical means as described above.

Further, when a timing switch is separately disposed in the lower portion, the height of accumulation lower than the normal height of accumulation can be detected by the same means as described above and a shortage of the number of coins can be checked.

In the present invention, by adoption of the above-mentioned structure, irregular arrangement of accumulated coins can be detected very precisely without scattering of coins. The present invention is therefore extremely advantageous and effective from the practical viewpoint.

What is claimed is:

1. An apparatus for detecting irregular arrangement of accumulated coins, the irregular arrangement of accumulated coins having a greater height than a regular arrangement of accumulated coins, the apparatus delivering a predetermined number of accumulated coins from an accumulating cylinder to a packaging zone for packaging and comprising:

a pair of delivery arms, one of which is an upper delivery one and the other of which is a lower delivery one adapted to be insulated from the upper one, rotatable between a coin accumulating zone and a coin packaging zone and vertically slidable to engage with and disengage from the accumulated coins in the coin accumulating zone, and a detection circuit for detecting the irregular arrangement of the accumulated coins by sensing an increased height of the upper delivery arm when the pair of delivery arms engages with the accumulated coins.

2. An apparatus as set forth in claim 1 wherein said detection circuit comprises a DC amplifier which is energized when the pair of delivery arms engages with the accumulated coins and a reed switch is closed with the reed switch being disposed so that it is energized when the upper delivery arm comes down to a predetermined position indicating the irregular arrangement of the accumulated coins.

3. An apparatus as set forth in claim 2 wherein said detection circuit further comprises a relay which is energized by said DC amplifier to cause reverse movement of a motor for vertically moving the pair of delivery arms and thereby discharging the irregularly accumulated coins.

4. An apparatus as set forth in claim 2 wherein said reed switch is disposed adjacent the vertical passage of the upper delivery arm so that the reed switch is caused to be closed when a magnet mounted on the upper delivery arm comes up to the reed switch.

5. An apparatus as set forth in claim 4 wherein said reed switch is vertically adjustable in accordance with species of coins.

6. An apparatus for detecting irregular arrangement of accumulated coins, the irregular arrangement of accumulated coins having a greater height than a regular arrangement of accumulated coins, the apparatus delivering a predetermined number of accumulated coins from an accumulating cylinder to a packaging zone for packaging and comprising:

upper and lower electrically conductive delivery arms electrically insulated from each other;

means for rotating said arms between a coin accumulating zone and a coin packaging zone;

means for vertically moving said arms towards each other to engage and disengage coins in the coin accumulating zone;

means for electrically energizing one of said arms so that a first electric circuit is completed when said arms engage coins in the coin accumulating zone;

means for completing a second electric circuit, and means including a switch closed when vertical movement of said upper delivery arm is stopped by contact with the uppermost coin of an irregular arrangement of accumulated coins; and means responsive to simultaneous completion of said first and second electric circuits for preventing rotation of said arms to said coin packaging zone.

7. An apparatus according to claim 6, wherein said switch is magnetically operated and spaced from the path of vertical movement of said upper arm, said upper arm carrying a magnet for closing said switch.

* * * * *